United States Patent [19]

Mise

[11] Patent Number: 4,791,096

[45] Date of Patent: Dec. 13, 1988

[54] COLOR-FORMING COMPOSITION

[75] Inventor: Noritoshi Mise, Takatsuki, Japan

[73] Assignee: Takeda Chemical Industries, Ltd., Osaka, Japan

[21] Appl. No.: 125,606

[22] Filed: Nov. 25, 1987

[30] Foreign Application Priority Data

Nov. 27, 1986 [JP] Japan ..... 61-283952
Feb. 12, 1987 [JP] Japan ..... 62-29999

[51] Int. Cl.[4] ..... B41M 5/16; B41M 5/18; B41M 5/22

[52] U.S. Cl. ..... 503/216; 106/21; 427/150; 428/913; 428/914; 503/225

[58] Field of Search ..... 106/21; 427/150–152; 503/216, 217, 225, 218; 428/913, 914

[56] References Cited

U.S. PATENT DOCUMENTS 3,870,479 3/1975 Kubotera et al. ..... 420/204
4,013,473 3/1977 Willems et al. ..... 430/348
4,379,835 4/1983 Lowrey et al. ..... 430/332
4,416,966 11/1983 Sanders et al. ..... 430/138
4,456,669 6/1984 Yubakami et al. ..... 430/201
4,511,642 4/1985 Higashi et al. ..... 430/161

FOREIGN PATENT DOCUMENTS 60101171 11/1983 Japan ..... 503/216

*Primary Examiner*—Bruce H. Hess
*Attorney, Agent, or Firm*—Wenderoth, Lind & Ponack

[57] ABSTRACT

A color-forming composition which comprises a chromogenic dye and, as a color developer, an L-ascorbic acid 5,6-O-ketal or -acetal or an erythorbic acid 5,6-O-ketal or -acetal has good storage stability before color development. Images after color development are distinct and have high color density and good durability. The composition is useful as a color-forming composition in heat-sensitive or pressure-sensitive recording materials.

5 Claims, No Drawings

COLOR-FORMING COMPOSITION

This invention relates to a color-forming composition. Compositions causing color development or color change upon heating or application of pressure are utilized as temperature-indicating paints, heat-sensitive recording materials and pressure-sensitive recording materials, among others. In particular, information media, typically facsimile, in which they are used, are rapidly expanding. Under these circumstances, the present invention provides a color-forming composition having good storage stability before color development, giving and retaining clear and distinct color images after color development and undergoing only inconsiderable changes in color with the passage of time or by contact with a plasticizer, marked pen's ink, lipstick and so on.

Color-forming compositions generally comprise a chromogenic dye and a color developing agent which reacts with said dye to cause color development upon heating or application of pressure. The so-called leuco dyes which contain the lactone, lactam or spiropyran ring and are normally colorless or light-colored are known as the dye, and organic acids, salts thereof, phenolic compounds and activated clay, for instance, are known as the color developer. Among the color developing agents or color developers, phenolic compounds, such as bisphenol A and tert-butylphenol, are commonly used as a heat-sensitive developer. While they advantageously give clear-cut and distinct color images with high density, the phenolic compounds are said to be still unsatisfactory with respect to storage stability before color development and durability after color development. For example, the thermal recording paper becomes slightly grayish with the passage of time.

As a measure for improvements in such disadvantage features of the phenolic color developers, the use of ascorbic acid and derivatives thereof has recently been proposed (Japanese Unexamined Patent Publication No. 60-101171). However, since it is soluble in water, ascorbic acid tends to cause color development already in the step of mixing with the dye in water to make an aqueous dispersion. Furthermore, color images after color development tend to gradually blur and/or discolor, for instance. Therefore, ascorbic acid is still unsatisfactory in practicability. Ascorbic acid derivatives, for example higher fatty acid esters such as ascorbic acid stearate, have decreased water solubility, hence are less apt to cause troubles due to leakage of water, and so on, but they still have problems, namely their color developing sensitivity becomes decreased accordingly, so that the color density or intensity and distinctness of images become unsatisfactory.

The present inventor has now found that the use of a ketal or acetal of L-ascorbic acid or a ketal or acetal of erythorbic acid as the color developer in a color-forming composition comprising a chromogenic dye and a color developer can give a composition having good storability and.color developing ability as well as good color stability.

Thus the invention consists in a color-forming composition which comprises an L-ascorbic acid 5,6-O-ketal or acetal or erythorbic acid 5,6-O-ketal or acetal as color developer in combination with a chromogenic dye.

The 5,6-O-ketal and 5,6-O -acetal of the present invention can be represented by the general formula:

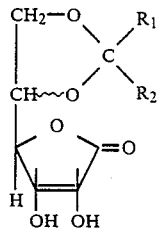

5,6-O-Ketal moieties which can be used in practicing the invention have the general formula

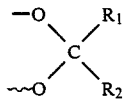

wherein $R_1$ and $R_2$ are the same or different and each is an alkyl or phenyl group and $R_1$ and $R_2$ may combinedly form a cycloalkylene ring together with the adjacent carbon atom. As the alkyl group represented by $R_1$ and/or $R_2$, there may be mentioned alkyl groups containing 1–5 carbon atoms, such as methyl, ethyl, propyl, isopropyl, butyl, isobutyl, sec-butyl, tert-butyl, amyl and tert-amyl. The phenyl group represented by $R_1$ and/or $R_2$ may be substituted by one or more substituents each selected from among alkoxy of 1–10 carbon atoms, alkyl of 1–5 carbon atoms, etc. In forming a cycloalkylene ring, $R_1$ and $R_2$ may form an alkylene group containing 4–6 carbon atoms, such as tetramethylene, pentamethylene or hexamethylene, and the cycloalkylene group may be substituted by one or more substituents, for example one or more alkyl groups containing 1–5 carbon atoms (e.g. methyl, ethyl, n-propyl, n- or t-butyl). Preferred among such ketals are cyclic ketone-derived ketals such as 5,6-O-($C_{1-5}$alkyl-substituted or unsubstituted cyclohexylidene)-L-ascorbic acid and 5,6-O-($C_{1-5}$alkyl-substituted or unsubstituted cyclohexylidene)erythorbic acid.

The ketals to be used in accordance with the invention can be produced readily, by the method described in, for example, Japanese Unexamined Patent Publication No. 60-69079.

5,6-0-Acetal moieties which can be used in practicing the invention have the general formula

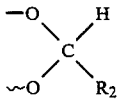

($R_1$ = H)

wherein $R_2$ is an alkyl or phenyl group. As the alkyl group represented by $R_2$, there may be mentioned alkyl groups containing 1–20 carbon atoms, such as methyl, ethyl, propyl, butyl, i-butyl, amyl, hexyl, octyl, nonyl, decyl, tetradecyl and stearyl. Preferred are those alkyl groups which contain 7–17 carbon atoms. The alkyl group may be substituted by a phenyl group. When $R_2$ is a phenyl group, it may have one or more substituents such as alkoxy of 1–10 carbon atoms, alkyl of 1–5 carbon atoms, etc. Preferred among such acetals are 5,6-O-(p-n-octyloxybenzylidene)-L-ascorbic acid, 5,6-O-dodecylidene-L-ascorbic acid and 5,6-O-octadecylidene-L-ascorbic acid, for instance.

The acetals to be used in accordance with the invention can be produced easily by the methods described in Organic Preparations and Procedures, 3, 299 (1971), Journal of Agricultural and Food Chemicals, 28, 1274 (1980), Netherlands Patent Application laid open under No. 7805427 (1978) and elsewhere.

As the chromogenic dye to be used in the practice of the invention, there may be mentioned dyes generally called leuco dyes, including, among others, diarylphthalides, polyarylcarbinols, leuco auramines, acylauramines, arylauramines, rhodamine B lactams, indolines, spiropyrans and fluorans. Typical examples are crystal violet lactone, malachite green lactone, Michler's hydrol, crystal violet carbinol, malachite green carbinol, N-(2,3-dichlorophenyl)leuco-auramine, N-benzoylauramine, N-acetylauramine, N-phenylauramine, rhodamine B lactam, 2-(phenyliminoetylidene)-3,3-dimethylindoline, N,3,3-trimethylindolinobenzospiropyran, 8-methoxy-N, 3,3-trimethylindolinobenzospiropyran, 3-diethylamino-6-methyl-7-chlorofluoran, 3-diethylamino-6-methyl-7-anilinofluoran, 3-diethylamino-7-methoxyfluoran, 3-dibutylamino-6-methyl-7-anilinofluoran, 3-diethylamino-6-benzyloxyfluoran and 1,2-benzo-6-diethylaminofluoran, among others.

In the composition according to the invention, the weight ratio of the color developer ketal or acetal to such dye is generally within the range of 0.3–10, pareferably 1–5.

The color-forming composition according to the invention can be used in heat-sensitive recording media, such as heat-sensitive recording paper sheets, or in pressure-sensitive recording media, such as carbonless duplicating paper sheets.

In using said composition in heat-sensitive recording materials, a binde, a dispersant solvent, a sensitizer and other additives (e.g. titanium oxide, calcium carbonate, talc, other inorganic pigments, waxes, stabilizers, surfactants), for instance, are generally incorporated additionally. Usable as the binder are synthetic resins, such as acrylic resins, polyvinyl alcohol, vinyl acetate copolymers, polyurethane resins, epoxy resins and polyester resins, and natural macromolecular substances, such as cellulosic polymer. The binder is not limited to these, however, and any binder capable of dispersing the dye and color developer uniformly but incapable of causing reaction or gelation may be used. Water, alcohols, toluene, xylene, ethyl acetate, butyl acetate and the like are useful dispersant solvents.

In manufacturing heat-sensitive recording materials using the color-forming composition according to the invention, the composition is first dispersed in the solvent together with the binder, followed by addition of various additives as necessary. The resulting dispersion is then applied to a substrate such as a paper sheet, cloth, film or some other sheet material, followed by drying. The coating weight is not particularly limited but generally the dye and color developer are used each in an amount of 0.1–20 g/m$^2$, preferably 0.3–10 g/m$^2$. The colorforming composition according to the invention develops color generally at a temperature of 80°–150° C., particularly 100°–130° C.

In using the color-forming composition according to the invention in pressure-sensitive recording materials, said composition can be applied to both the single type and the transfer type comprising an upper and a lower sheet. Single-type recording materials can be produced by coating a substrate first with a microcapsule dispersion containing the dye encapsulated in minute capsules and then further with a color developer composition containing the ketal or acetal, followed by fixation. Transfer-type pressure-sensitive recording materials can be produced by providing one of the upper and lower sheets with the dye (or microcapsules containing the dye) and the other with the color developer (or microcapsules containing the same). Also in the manufacture of these pressure-sensitive recording materials, the above-mentioned binder, dispersant solvent and other additives can be used. In encapsulating the ketal or acetal according to the invention, the ketal or acetal is dispersed or dissolved in a hydrophobic medium and then encapsulated. As such medium, there may be mentioned, for example, vegetable fats and oils, such as linseed oil, castor oil and tung oil; mineral oils, such as liquid paraffin; aromatic hydrocarbons, alcohols, esters, ethers, amides, and plasticizers.

The color-forming composition according to the invention has improved storage stability before color development. Images after color development are distinct and have high color density and good durability (e.g. water resistance). In particular, the heat-sensitive or pressure-sensitive recording paper sheet prepared with the composition of the invention containing the ketal component as a developer displays excellent color developing sensitivity and good resistance to plasticizer and water as compared with that of the 6-stearylascorbate. The heat-sensitive or pressure-sensitive recording paper sheet prepared with the composition of the invention containing the acetal component as a developer has excellent whiteness and displays resistance to water as compared that of the 6-stearylascorbate. The composition is thus useful as a color-forming composition in heat-sensitive or pressure-sensitive recording sheet materials.

The following examples are further illustrative of the present invention.

The evaluation of a heat-sensitive or pressuresensitive paper sheet was conducted by the following testing methods:

Whiteness: Whiteness is represented by a optical density value (simply referred to as O.D. value hereinafter) which can be measured on Macbeth color meter (Type TC-6D manufactured by Tokyo Denshoku Co.).

Resistance to light: A color-developed spot of the paper sheet is irradiated on a fluorescent lamp (about 40,000 lux) for 96 hours and the O.D. value of the spot after irraditation is measured. The percentage of the O.D. value of the spot after treatment the O.D. value of the color-developed spot before irradiation is calculated.

Color-developing sensitivity: Color-developing sensitivity is represented by a temperature difference ($\Delta T$).

$\Delta T = T_2 - T_1$ $T_1$: a temperature at which O.D. value has reached at 0.5

$T_2$: a temperature at which O.D. value has reached at 0.9

It can be said that the smaller the difference is, the better the color-developing sensitivity is.

Resistance to plasticizer: The color-developed spot is contacted with a plastic eraser containing a plasticizer under the pressure of 200 g/cm$^2$. After 24 hours, the O.D. value of the treated spot is measured. The percentage of the O.D. value of the treated spot to that of the spot before treatment is calculated.

EXAMPLE 1

Crystal violet lactone (2.5 g) was thoroughly comminuted in a mortar, 20 ml of a 10% aqueous solution of polyvinyl alcohol (POVAL UP-180®; Unitika Kasei, Ltd.) was added, and the mixture was kneaded in the mortar for 30 minutes to give a dye dispersion. Separately, 2.5 g of crystalline 5,6-O-cyclohexylidene-L-ascorbic acid was thoroughly comminuted in a mortar, 20 ml of a 10% aqueous solution of POVAL® UP-180 was added, and the mixture was kneaded in the mortar for 30 minutes to give a color developer dispersion.

Both the dispersions were mixed in a ratio of 1:1. The color-forming composition thus obtained was applied to a filter paper (TOYO's filter paper No. 2) using a No. 30 bar coater. The subsequent drying gave a heat-sensitive recording paper sheet.

This heat-sensitive recording paper sheet was applied onto an iron plate, and the iron plate was gradually heated. At 135°-145° C. [as determined by using THERMOLABEL (Nichiyu Giken Kogyo LTD)], a distinct deep blue color was produced. This paper sheet (after color development) and the heat-sensitive paper sheet before color development were exposed to the light by the window at room temperature for 3 months. In either case, changes with the passage of time, such as discoloration, were not observed at all. The resistance to plasticizer of the color-developed sheet was 96% and the color developing sensitivity was 14° C.

EXAMPLE 2

3-Diethylamino-6-methyl-7-anilinofluoran (Yamamoto Kasei LTD) (2.5 g) was thoroughly comminuted in a mortar, 20 ml of a 10% aqueous solution of POVAL® UP-180 was added, and the mixture was kneaded well to give a dye dispersion.

Separately, 2.5 g of crystalline 5,6-O-cyclohexylidene-L-ascorbic acid was thoroughly comminuted in a mortar, 20 ml of a 10% aqueous solution of POVAL® UP-180 was added, and the mixture was kneaded well to give a color developer dispersion.

Both the dispersions were mixed together in a ratio of 1:1 to give a color-forming composition. A wood free paper was coated with this composition using a bar coater, followed by drying. The thus-obtained heat-sensitive recording paper sheet was heated on an iron plate in the same manner as in Example 1. It assumes a dark black color at 135°-140° C. This colored paper sheet and the heat-sensitive recording paper sheet before color development were exposed to the light by the window at room temperature for 3 months. For either sheet, discoloration or other changes were not observed with the passage of time.

COMPARATIVE EXAMPLE 1

A heat-sensitive recording paper sheet was obtained in the same manner as in Example 1 except that L-ascorbic acid 6-stearate was used in lieu of 5,6-O-cyclohexylidene-L-ascorbic acid. The paper sheet was heated on an iron plate in the same manner as in Example 1 and observed for the extent of color development. At 100°-110° C., a faded, pale blue color was produced. It was revealed that the heat-sensitive paper sheet of Example 1 was much higher in color development intensity or color density than the paper sheet of this comparative example. The sheet after color development was immersed overnight in water and dried, and compared with the sheet before immersion. The color retention ratio was 58%. The resistance to plasticizer of the color-developed sheet was 83% and the color developing sensitivity was 21° C.

COMPARATIVE EXAMPLE 2

A heat-sensitive recording paper sheet was obtained in the same manner as in Example 1 except that ascorbic acid 2,6-dipalmitate was used in lieu of 5,6-O-cyclohexylidene-L-ascorbic acid. The heat-sensitive paper sheet thus obtained was heatedon an iron plate. A faded, pale blue color was developed at 100°-130° C. It was thus found that the heat-sensitive sheet of Example 1 was much higher in color density as compared with the sheet of this comparative example.

EXAMPLE 3

A mixture of 1 g of crystal violet lactone, 1 g of soybean oil and 5 g of methyl ethyl ketone was stirred until homogeneous dissolution was achieved. A filter paper (11 $cm^2$; Toyo Filter Paper LTD.) was coated with the solution and then dried to give a dye-impregnated paper sheet. A fine powder of 5,6-O-cyclohexylidene-L-ascorbic acid was uniformly spread over the paper sheet and then covered with a cellophane sheet. Drawing images with a steel pen resulted in development of a blue-back color.

EXAMPLE 4

Crystal violet lactone (2.5 g) was thoroughly comminuted in a mortar, 20 ml of a 10% aqueous solution of polyvinyl alcohol (POVAL® UP-180; Unitika Kasei LTD.) was added, and the mixture was kneaded in the mortar for 30 minutes to give a dye dispersion. Separately, 2.5 g of crystalline 5,6-O-benzylidene-L-ascrobic acid was thoroughly comminuted in a mortar, 20 ml of a 10% aqueous solution of POVAL® UP-180 was added, and the mixture was kneaded in the mortar for 30 minutes to give a color developer dispersion.

Both the dispersions were mixed in a ratio of 1:1. The color-forming composition thus obtained was applied to a filter paper (Toyo's filter paper No. 2) using a No. 30 bar coater. The subsequent drying gave a heat-sensitive recording paper sheet.

This heat-sensitive recording paper sheet was applied onto an iron plate, and the iron plate was gradually heated. At 135°-145° C. as determined by using THERMOLABEL (Nichiyu Giken Kogyo LTD), a distinct deep blue color was produced. This paper sheet and the heat-sensitive paper sheet before color development were exposed to the light by the window at room temperature for 3 months. In either case, changes with the passage of time, such as discoloration, were not observed at all.

EXAMPLE 5

A heat-sensitive recording paper sheet was prepared in the same manner as in Example 4 except that 5,6-O-dodecylidene-L-ascorbic acid was substituted for 5,6-O-benzylidene-L-ascorbic acid. The whiteness of the paper sheet was 0.05. This heat-sensitive recording sheet was heated on an iron plate and observed for color development. A distinct deep blue color was produced at 100°-110° C. This colored sheet was exposed to the light by the window at room temperature for 3 months. Any changes, such as discoloration, were noticed with the lapse of time. The sheet after color development was immersed overnight in water and dried, and compared with the sheet before immersion. Little discoloration was observed.

EXAMPLE 6

A mixture of 1 g of crystal violet lactone, 1 g of soybean oil and 5 g of methyl ethyl ketone was stirred until homogeneous dissolution was achieved. A filter paper sheet (Toyo's filter paper No. 2) was coated with the solution and dried to give a dye-impregnated paper sheet. This paper sheet was further coated with a dispersion of 5,6-O-dodecylidene-L-ascorbic acid in a 10% aqueous solution of POVAL®-180, and then dried. Images were drawn with a steel pen, whereby a blue-black color was developed.

EXAMPLE 7

3 g of Parffin (m.p. 60°-62° C.; marketed by Wako Pure Chem. Ind., LTD) and 1 g of 3-diethylamino-6-methyl-7-anilinofluoran (manufactured by Yamamoto Kasei, LTD) were dispersed in 100 ml of water at 70° C. in the presence of 0.03 g of silicon surfactant (Silwet®L-7604; marketed by Nihon Unikar, LTD) under stiring. The dispersion was cooled and filtered to obtain a micro powder of fluoran dye.

One gram of the powder was coated on a white paper sheet (15 cm×15 cm) at 80° C. Two gram of a fine powder of 5,6-O-cyclopentylidene-L-ascorbic acid was uniformly spread over the dye-impregnated paper sheet and the sheet was covered with a cellophane. Drawing images with a steel pen resulted in development of a black color.

EXAMPLE 8

A pressure-sensitive recording paper sheet was obtained in the same manner as in Example 7 except that 1 g of 5,6-O-isopropylidene-erythorbic acid was used in place of cyclopentylidene-L-ascorbic acid. Drawing images with a steel pen resulted in development of black color.

EXAMPLE 9

A heat-sensitive recording paper sheet was obtained in the same manner as in Example 1 except that 1 part by weight of the dispersion of crystal violet lactone and 5 parts by weight of the dispersion of 5,6-O-cyclohexylidene-L-ascorbic acid were used. A distinct deep blue color developed when heating the sheet at 140° C.

The color-forming part of the sheet was treated with a plastic erraser to examine resistance to plasticizer. The resistance was 98%.

EXAMPLE 10

A heat-sensitive paper sheet was obtained in the same manner as in Example 2 except that 5,6-O-(p-t-butylcyclohexylidene)-L-ascorbic acid was used in lieu of 5,6-O-cyclohexylidene-L-ascorbic acid.

The heat-sensitive paper sheet thus obtained was heated on an iron plate which was gradually heated. A dark black color was produced at 155°-165° C. The sheet after color development was immersed overnight in water and dried, and compared with the sheet before immersion. The color retention ratio was 80%. The color developing sensitivity was 12° C. The resistance to plasticizer was 95%.

EXAMPLE 11

A heat-sensitive paper sheet was produced in the same manner as in Example 2 except that 5,6-O-(3-methylcyclohexylidene)-L-ascorbic acid was used in lieu of 5,6-O-cyclohexylidene-L-ascorbic acid. The heat-sensitive recording paper sheet thus obtained was heated on an iron plate which was gradually heated. A dark black color was produced at 115°-125° C. The sheet after color development was immersed overnight in water, and dried, and compared with the sheet before immersion. The color retention ratio was 98%. The color developing sensitivity was 19° C., and resistance to plasticizer was 93%.

EXAMPLE 12

A heat-sensitive paper sheet was produced in the same manner as in Example 2 except that 5,6-O-(p-n-octyloxybenzylidene)-L-ascorbic acid was used in lieu of 5,6-O-cyclohexylidene-L-ascorbic acid. The heat-sensitive paper sheet thus obtained was heated on an iron plate which was grandually heated. A dark black color was produced at 110°-120° C. The sheet after color development was immersed overnight in water, and dried, and compared with the sheet before immersion. The color retention ratio was 70%. The color developing sensitivity was 7° C., and resistance to plasticizer was 90%.

REFERENCE EXAMPLE 1

Production of 5,6-O-(4-tert-butylcyclohexllidene)-L-ascorbic acid:

A mixture of 4-tert-butylcyclohexanone (43.8 g, 0.284 mol), ascorbic acid (10.0 g, 0.056 mol) and iodine 6.4 mg in dry dichloromethane (50 ml) was refluxed for 6 hours, during which water was removed by molecular sieves 3A (ca. 20 g). Then the hot reaction mixture was filtered in order to remove the unreacted ascorbic acid, and the filtrate was cooled down. The crystallized product was collected by filtration and washed with some cold dichloromethane. The yeild of the obtained product was 2.8 g and the m.p. is 225°-226° C.

REFERENCE EXAMPLE 2

Production of 5,6-O-(3-methylcyclohexylidene)-L-ascorbic acid:

This compound was prepared in accordance with the same procedure as in Reference Example 1 except that 3-methylcyclohexanone (29.8 g, 0.284 mol) and dry dichloromethane (35 ml) were used. The yield of the obtained product was 1.7 g and the m.p. is 176°-178° C.

REFERENCE EXAMPLE 3

Production of 5,6-O-(p-n-octyloxybenzylidene)-L-ascorbic acid:

This compound was prepared in accordance with the same procedure as in Reference Example 1 except that p-n-octyloxybenzaldehyde (50 g, 0.21 mol), ascorbic acid (7.5 g, 0.042 mol) and iodine (4.8 mg) and dichloroethane (50 ml) were used. To the filtrate hexane was added, by which the crystallized product was obtained. The yield was 0.2 g and the m.p. is 140° C.

I claim:

1. A color-forming composition which comprises a chromogenic dye and, as a color developer, an L-ascorbic acid 5,6-O-ketal or -acetal or an erythorbic acid 5,6-O-ketal or acetal.

2. A color-forming composition according to claim 1, wherein the weight ratio of the color developer to the chromogenic dye is within the range of 0.3 to 10.

3. A color-forming composition according to claim 1, wherein the color developer ketal and acetal is represented by the general formula:

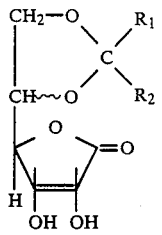

wherein (i) $R_1$ and $R_2$ are the same or different and are $C_{1-5}$ alkyl or phenyl which may be substituted by one or more $C_{1-10}$ alkoxy or $C_{1-5}$ alkyl, or they may form a cycloalkylene together with the adjacent carbon atom and the cycloalkylene ring may be substituted by one or more $C_{1-5}$ alkyl, or (ii) $R_1$ is hydrogen and $R_2$ is $C_{1-20}$ alkyl or phenyl whioh may be substituted by one or more $C_{1-10}$ alkoxy or $C_{1-5}$ alkyl.

4. A heat-sensitive recording material comprising a substrate to which the color-forming composition according to claim 1 is applied.

5. A pressure-sensitive recording material comprising a substrate to which color-forming composition according to claim 1 is applied.

* * * * *